US011260443B2

(12) United States Patent
Tobita et al.

(10) Patent No.: US 11,260,443 B2
(45) Date of Patent: Mar. 1, 2022

(54) METHOD FOR MANUFACTURING PRESS FORMED PRODUCT

(71) Applicant: JFE Steel Corporation, Tokyo (JP)

(72) Inventors: Shunsuke Tobita, Tokyo (JP); Toyohisa Shinmiya, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 55 days.

(21) Appl. No.: 16/636,786

(22) PCT Filed: Jul. 25, 2018

(86) PCT No.: PCT/JP2018/027943
§ 371 (c)(1),
(2) Date: Feb. 5, 2020

(87) PCT Pub. No.: WO2019/031248
PCT Pub. Date: Feb. 14, 2019

(65) Prior Publication Data

US 2020/0376532 A1 Dec. 3, 2020

(30) Foreign Application Priority Data

Aug. 7, 2017 (JP) ..... JP2017-152412

(51) Int. Cl.
*B21D 5/06* (2006.01)
*B21D 22/02* (2006.01)

(52) U.S. Cl.
CPC ..... *B21D 5/06* (2013.01); *B21D 22/02* (2013.01)

(58) Field of Classification Search
CPC ..... B21D 22/02; B21D 22/20; B21D 22/21; B21D 22/22; B21D 22/26; B21D 22/30; B21D 5/06
(Continued)

(56) References Cited

U.S. PATENT DOCUMENTS 9,981,298 B2 * 5/2018 Shinmiya ..... B21D 5/10 72/379.2
10,226,807 B2 * 3/2019 Shinmiya ..... B21D 22/06 72/379.2
(Continued)

FOREIGN PATENT DOCUMENTS

CN 202516933 U 11/2012
CN 103480704 A 1/2014
(Continued)

OTHER PUBLICATIONS

Extended European Search Report for European Application No. 18844874.0, dated Jun. 18, 2020, 8 pages.
(Continued)

*Primary Examiner* — Adam J Eiseman
*Assistant Examiner* — Matthew Stephens
(74) *Attorney, Agent, or Firm* — RatnerPrestia

(57) ABSTRACT

A method for manufacturing a press formed product is disclosed. The manufacturing method includes a first step of manufacturing an intermediate component by forming the curved part such that a line length along the longitudinal direction of a curved convex side WA is shorter than a line length in the product shape and a line length along the longitudinal direction of a curved concave side WB is longer than a line length in the product shape; and a second step of forming the intermediate component such that a line length of the curved convex side WA is longer than the line length in the first step and a line length of the curved concave side WB is shorter than the line length in the first step.

12 Claims, 4 Drawing Sheets

(58) Field of Classification Search
USPC ..... 72/352
See application file for complete search history.

(56) References Cited

U.S. PATENT DOCUMENTS

| | | | | |
|---|---|---|---|---|
| 10,737,307 | B2 * | 8/2020 | Sumikawa | B21D 5/01 72/379.2 |
| 2012/0119418 | A1 | 5/2012 | Verbeek et al. | |
| 2015/0367397 | A1 * | 12/2015 | Uchiyama | B21D 22/26 72/379.2 |
| 2016/0121384 | A1 * | 5/2016 | Sumikawa | B21D 22/02 72/352 |
| 2018/0065164 | A1 | 3/2018 | Sumikawa et al. | |
| 2020/0384522 | A1 * | 12/2020 | Flehmig | B21D 22/30 72/379.2 |

FOREIGN PATENT DOCUMENTS

| | | | | | |
|---|---|---|---|---|---|
| EP | 2459332 | B1 | | 6/2013 | |
| JP | 2007313533 | A | * | 12/2007 | B21D 22/00 |
| JP | 2007313533 | A | | 12/2007 | |
| JP | 2008221289 | A | | 9/2008 | |
| JP | 2010064138 | A | | 3/2010 | |
| JP | 2011183417 | A | | 9/2011 | |
| JP | 2015131306 | A | * | 7/2015 | B21D 22/26 |
| JP | 2015131306 | A | | 7/2015 | |
| JP | 2015174124 | A | | 10/2015 | |
| JP | 2016087640 | A | | 5/2016 | |
| WO | 2016132905 | A1 | | 8/2016 | |
| WO | 2017141603 | A1 | | 8/2017 | |
| WO | WO-2018030240 | A1 | * | 2/2018 | B21D 22/20 |

OTHER PUBLICATIONS

International Preliminary Report on Patentability and Written Opinion for International Application No. PCT/JP2018/027943, dated Feb. 11, 2020, 8 pages.
International Search Report and Written Opinion for International Application No. PCT/JP2018/027943, dated Oct. 23, 2018, 6 pages.
Japanese Office Action for Japanese Application No. 2017-152412, dated Feb. 25, 2020, with Concise Statement of Relevance of Office Action, 7 pages.
Chinese Office Action with Search Report for Chinese Application No. 201880051164.3, dated Nov. 27, 2020, 10 pages.

* cited by examiner

METHOD FOR MANUFACTURING PRESS FORMED PRODUCT

CROSS REFERENCE TO RELATED APPLICATIONS

This is the U.S. National Phase application of PCT/JP2018/027943, filed Jul. 25, 2018, which claims priority to Japanese Patent Application No. 2017-152412, filed Aug. 7, 2017, the disclosures of these applications being incorporated herein by reference in their entireties for all purposes.

FIELD OF THE INVENTION

The present invention relates to a method for manufacturing a press formed product, by which a high tensile strength steel sheet or another metal sheet is formed into a product shape component having a cross-sectional shape in which both sides of a top plate part in a width direction are continuous with side wall parts, such as a hat-shaped cross-section and a U-shaped cross-section, and having a curved part curved in the width direction along a longitudinal direction.

Two or more curved parts may exist along the longitudinal direction. In that case, a straight part may exist between adjacent curved parts.

BACKGROUND OF THE INVENTION

In order to satisfy both of improvement in crash safety and weight saving of a vehicle body, application of a high tensile strength steel sheet to a vehicle structural component has been recently developed. However, since the high tensile strength steel sheet has high yield strength and tensile strength, a forming defect such as spring-back becomes one of major problems in performing press forming.

Examples of a press formed product used in a vehicle structural component include a hat-shaped cross-section component having a top plate part and a flange part which curve in a product width direction at a predetermined curvature radius along a longitudinal direction in a planar view, such as an A pillar upper. When such a component is press formed, a compressive stress is generated on a curved convex side (convex side of curve) and a tensile stress is generated on a curved concave side (concave side of curve) at a forming bottom dead center, and spring-back in the product width direction is generated due to a stress difference thereof. When a metal sheet made of a high tensile strength steel sheet is press formed to manufacture such a component shape, a problem of increase in the stress difference at the bottom dead center described above and increase in the spring-back occurs. Furthermore, in the high tensile strength steel sheet, variation in a material strength becomes large, thereby leading to large variation in dimensional accuracy, in other words, there is a problem of poor material strength sensitivity.

As a conventional technology for the above problem, there are press forming methods described in PTLs 1 and 2.

The method described in PTL 1 proposes that, in a component having a substantially hat-shaped cross-section and curved in a width direction along a longitudinal direction, only end side flange parts having the substantially hat-shaped cross-section, which have been bending-processed in a preceding step, are unbent in a direction to cancel a residual stress. Accordingly, a stress to be generated in a subsequent step is reduced, thereby leading to suppression of spring-back.

The method described in PTL 2 proposes that, in a method for forming a component having a U-shaped or hat-shaped cross-section and a shape curved in a width direction along a longitudinal direction, for at least one curved part among curved parts, an intermediate component having a curved shape is formed in a preceding step such that the whole of the curved part has a curvature radius larger than that of a product shape, and furthermore, in a subsequent step, the intermediate component is formed such that the curvature radius becomes smaller than the curvature radius in the preceding step. Accordingly, a residual stress is canceled, and spring-back is reduced.

Patent Literature

PTL 1: JP 2015-174124 A
PTL 2: JP 2010-64138 A

SUMMARY OF THE INVENTION

However, in the method described in PTL 1, a die having a complex mechanism is required in unbending in the subsequent step.

Furthermore, in the method described in PTL 2, the stress is reduced by making the curvature radius of the whole of the curved part larger in the preceding step. However, in a stretch flange forming part on a bent inner side (concave side of curved part), a line length is surplus in the subsequent step because the curvature radius of the forming shape is made larger in the preceding step, and thus, it is difficult to cancel the stress sufficiently. Furthermore, the design of the curvature radius in the preceding step cannot be mechanically performed.

Aspects of the present invention have been made in view of the above problem, and it is an object according to aspects of the present invention to provide a method for manufacturing a press formed product, which can greatly reduce spring-back in a width direction along a longitudinal direction without complicating a die, even when a high tensile strength steel sheet is used.

In order to solve the problem, a method for manufacturing a press formed product of one embodiment of the present invention includes: when a metal sheet is press formed to manufacture a product having a product shape of a cross-sectional shape in which both sides of a top plate part in a width direction are continuous with side wall parts and having a curved part curved in the width direction along a longitudinal direction, a first step of manufacturing an intermediate component by forming the curved part such that a line length along the longitudinal direction of a curved convex side that is a convex side of a curve is shorter than a line length in the product shape and a line length along the longitudinal direction of a curved concave side that is a concave side of the curve is longer than a line length in the product shape; and a second step of forming the intermediate component such that a line length of the curved convex side is longer than the line length in the first step and a line length of the curved concave side is shorter than the line length in the first step.

According to the method for manufacturing a press formed product of one embodiment of the present invention, even when a high tensile strength steel sheet is used for a metal sheet, spring-back in a width direction can be greatly reduced without complicating a die. Accordingly, in one embodiment of the present invention, a component having a high-accuracy hat-shaped cross-section curved shape close to an intended product shape, which has a top plate part and side wall parts, can be obtained. More specifically, according to one embodiment of the present invention, a method for manufacturing a press formed product having excellent shape fixability and material strength sensitivity can be provided.

As a result, according to one embodiment of the present invention, even when the material strength varies, a component having high dimensional accuracy can be obtained, thereby leading to improvement in yield. Furthermore, for example, when a vehicle structural component is made using a component having a hat-shaped cross-sectional shape, assembly of the component can be easily performed.

DETAILED DESCRIPTION OF EMBODIMENTS OF THE INVENTION

Embodiments according to the present invention will be described below with reference to the drawings.

The embodiments described below illustrate configurations to embody the technical idea according to aspects of the present invention, and the technical idea according to aspects of the present invention does not limit the material, shape, structure, and the like of a component to those described below. Various changes can be added to the technical idea according to aspects of the present invention within the technical scope defined by claims.

Figure 1:
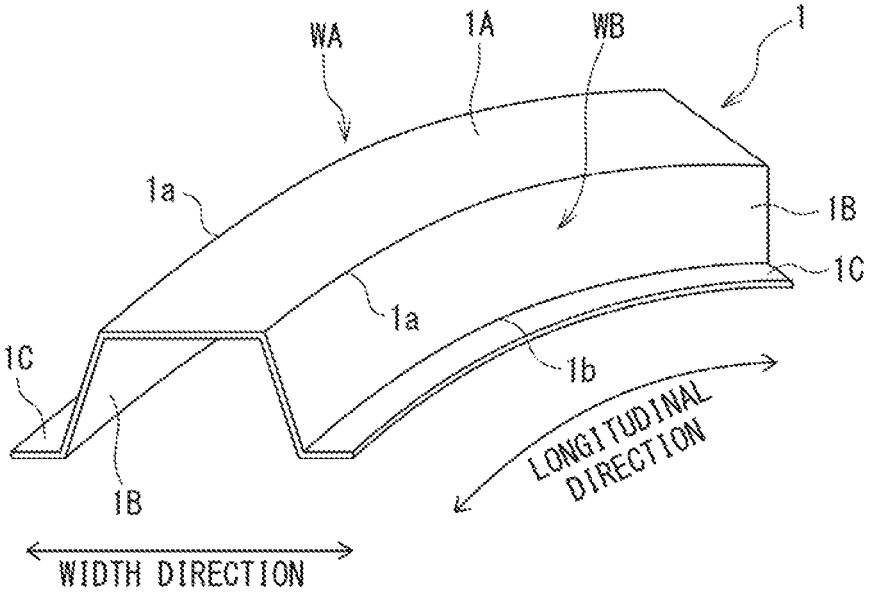
FIG. 1 is an oblique view illustrating an example of a product shape.

An intended product shape 1 of the present embodiment formed by press forming is, for example, as illustrated in FIG. 1, the product shape 1 having a cross-sectional shape in which both sides of a top plate part 1A in a width direction are continuous with side wall parts 1B and having a curved part curved in the width direction along a longitudinal direction. Representative examples of the cross-sectional shape in which the both sides of the top plate part 1A in the width direction are continuous with the side wall parts 1B include a hat-shaped cross-section and a U-shaped cross-section. In the case of the U-shaped cross-section, the side wall parts 1B are flanges.

In the case of the product shape 1 which has a hat-shaped cross-sectional shape, in which the top plate part 1A and flange parts 1C are continuous in the width direction through the side wall parts 1B, and curves in the width direction along the longitudinal direction (refer to FIG. 1), the top plate part 1A and the flange parts 1C curve along the longitudinal direction in a top view.

Figure 2:
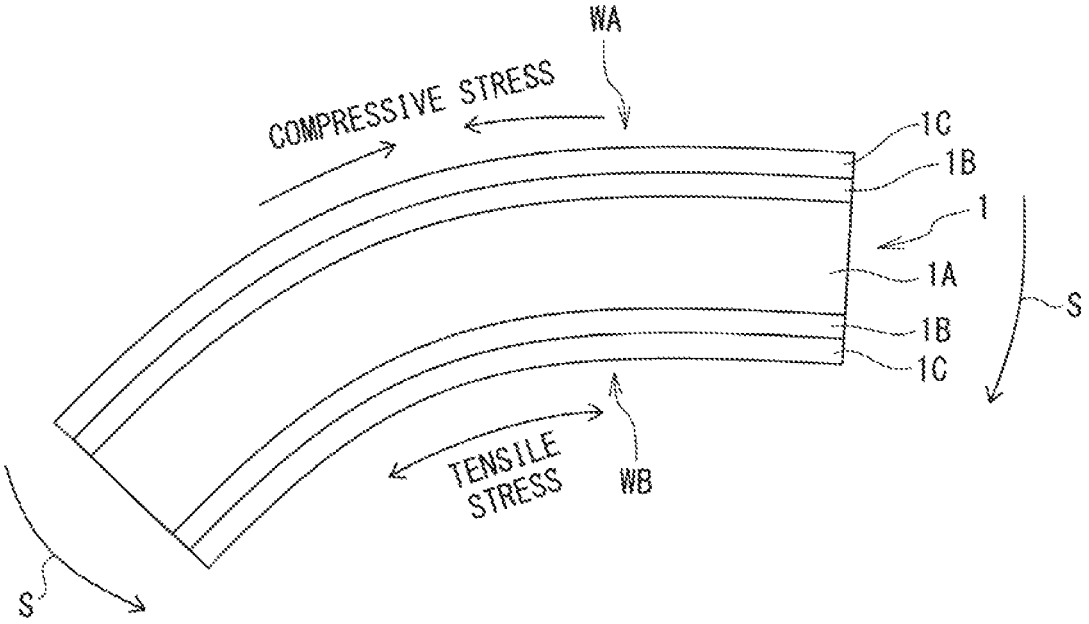
FIG. 2 is a schematic view viewed from above, which illustrates an example of a component having a hat-shaped cross-section and curved in a width direction along a longitudinal direction, and spring-back in this case.

When a metal sheet made of a tabular blank material is press formed into the product shape 1, as illustrated in FIG. 2, a compressive stress is generated on a curved convex side WA and a tensile stress is generated on a curved concave side WB, and spring-back in the product width direction is generated due to a stress difference thereof.

Figure 3:
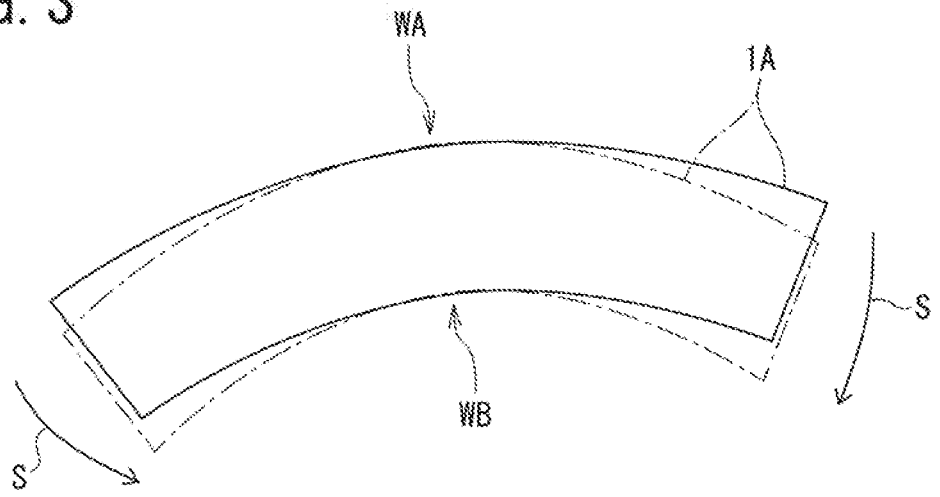
FIG. 3 is a schematic view of a top plate part viewed from above, which illustrates a state of the spring-back.

Then, when the stresses are released by removing the component from a pressing die, spring-back in the product width direction as indicated by the arrow S in FIG. 2 is generated, and both end sides in the longitudinal direction are displaced in the product width direction as illustrated in FIG. 3. For the sake of clarity, only the top plate part 1A is illustrated in FIG. 3, and the solid line indicates an example before the spring-back and the dashed-dotted line indicates an example after the spring-back.

In this case, when the residual stress increases with increasing the material strength of the metal sheet, the amount of spring-back in the width direction tends to increase. More specifically, the adoption of a high tensile strength steel sheet of 590 MPa or more causes large spring-back.

Figure 4A:
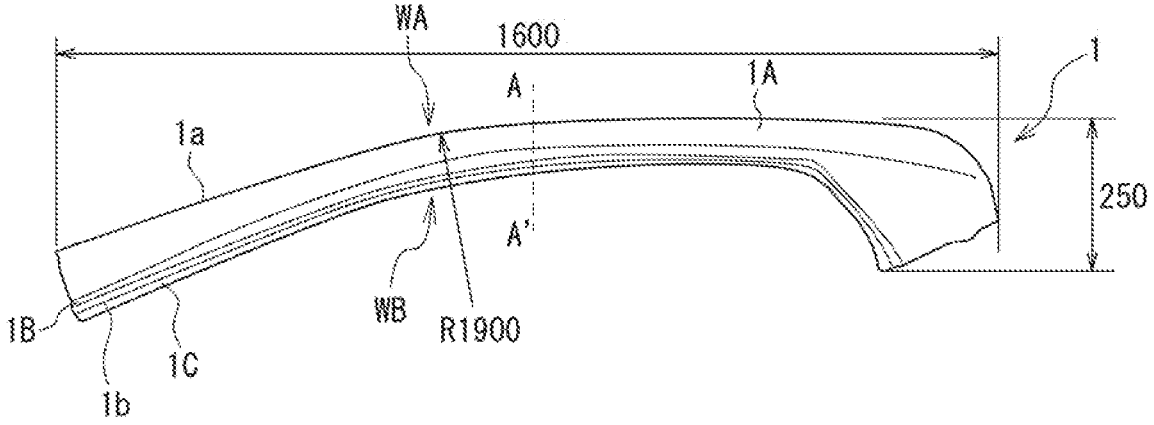
FIG. 4A is an oblique view and FIG. 4B is a cross-sectional view illustrating the product shape according to embodiments based on the present invention.
Figure 4B:
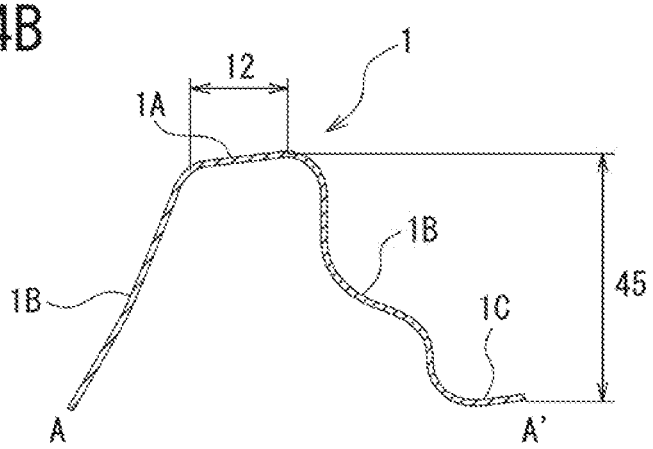

As the product shape 1 of the present embodiment manufactured by press forming, the shape illustrated in FIG. 4 is assumed. The product shape 1 is an example of the case of a hat-shaped cross-section component. In this example, the top plate part 1A and the flange part 1C are continuous in the width direction through the side wall part 1B, and the top plate part 1A and the flange part 1C curve in the width direction along the longitudinal direction in a top view. The curvatures of curves along the longitudinal direction may be the same but are different in the present embodiment.

In the example of the product shape illustrated in FIG. 4, a flange part continuous with the side wall part 1B is not provided on the curved convex side WA, and a stepped part extending in the longitudinal direction is provided on the side wall part 1B on the curved concave side WB, and the rigidity of the curved concave side WB becomes high.

A method for manufacturing a press formed product of the present embodiment includes a first step of manufacturing an intermediate component by press forming and a second step of forming the intermediate component into the product shape 1 by press forming.

The method for manufacturing a press formed product includes trim processing (not illustrated) for trimming the outer periphery of the flange. The trim processing may be performed before the first step, may be performed between the first step and the second step, or may be performed after the second step. In the present embodiment, the case where the trim processing is performed before press processing in the first step will be described. In this case, the intermediate component is a component in a state where the trim processing of the outer periphery of the flange has been performed.

The first step is a step of manufacturing the intermediate component by forming the curved part curved in the width direction along the longitudinal direction such that a line length along the longitudinal direction of the curved convex side WA that is a convex side of the curve is shorter than a line length in the product shape 1 and a line length along the longitudinal direction of the curved concave side WB that is a concave side of the curve is longer than a line length in the product shape 1. The intermediate component to be formed in the first step is formed into a shape according to the product shape 1 except for the above line lengths. As the metal sheet to be processed in the first step, even a steel sheet having a material strength of 590 MPa or more can be applied.

The second step is a step of forming the intermediate component such that a line length of the curved convex side WA is longer than the line length in the first step and a line length of the curved concave side WB is shorter than the line length in the first step.

As a representative of the above line lengths, the adjustment may be performed by, for example, line lengths at bent line positions 1*a* between the top plate part 1A and the side wall parts 1B and bent line positions 1*b* between the side wall parts 1B and the flange parts 1C (refer to FIG. 1).

Figure 5:
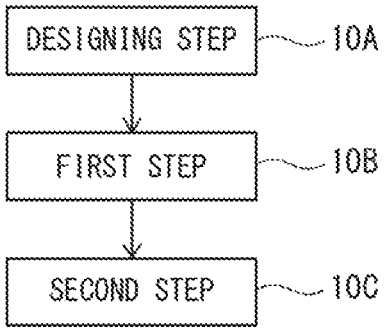
FIG. 5 is a view explaining steps of press forming according to the embodiments based on the present invention.

As illustrated in FIG. 5, the manufacturing method of the present embodiment includes a designing step 10A of designing a press shape after a first step 10B by performing, with a computer, simulation analysis of forming into the product shape 1, the first step 10B of forming a metal sheet with a die corresponding to the designed press shape, and a second step 10C performed after the first step 10B, as processing for forming a tabular metal sheet into the above product shape 1.

The designing step 10A is a designing step of calculating a shape, for the curved part curved in the width direction along the longitudinal direction, in which the line length along the longitudinal direction of the curved convex side WA that is a convex side of the curve is shorter than the line length in the product shape 1 and the line length along the longitudinal direction of the curved concave side WB that is a concave side of the curve is longer than the line length in the product shape 1, by simulation analysis with a computer, as described above. A die shape for the first step 10B for press forming into the designed shape is determined.

In the designing step 10A, as described below, the press shape is preferably designed on the basis of a line length of the longitudinal direction and the average amount of strain of the longitudinal direction in a stress region generated in the curved part.

For example, in the designing step 10A, a line length L1of the longitudinal direction and the average amount of strain ε1 of the longitudinal direction in a compressive stress region of the longitudinal direction generated on the curved convex side WA in the curved part are determined by performing, with a computer, simulation analysis in which the metal sheet is formed into the product shape 1 by one press forming. In the designing step 10A, when a line length of the curved convex side WA after the first step 10B is defined as L2, a line length of the first step 10B is set such that the following equation (1) is satisfied:

$$0<L1-L2\leq 2\times|L1\times\varepsilon 1| \quad (1).$$

Furthermore, for example, in the designing step 10A, a line length L1' of the longitudinal direction and the average amount of strain ε1' of the longitudinal direction in a tensile stress region of the longitudinal direction generated on the curved concave side WB in the curved part are determined by performing, with a computer, simulation analysis in which the metal sheet is formed into the product shape 1 by one press forming. In the designing step 10A, when a line length of the curved concave side after the first step 10B is defined as L2', a line length of the first step 10B is set such that the following equation (2) is satisfied:

$$0<L2'-L1'\leq 2\times|L1'\times\varepsilon 1'| \quad (2).$$

When (L1−L2) becomes larger than 2×|L1×ε1|, an excessive tensile stress is generated on the curved convex side at a forming bottom dead center in the second forming step, and spring-back in the opposite direction might be generated. Furthermore, when (L2'−L1') becomes larger than 2×|L1'×ε1'|, an excessive compressive stress is generated on the curved concave side at the forming bottom dead center in the second forming step, and spring-back in the opposite direction might be generated.

In the first step 10B, the metal sheet is press formed to manufacture the intermediate component using the die shape determined in the designing step 10A.

Drawing or stamping may be applied to the forming in the first step 10B.

As described above, the second step 10C is a step of forming the intermediate component such that, in the curved part, the line length of the curved convex side WA is longer than the line length in the first step 10B and the line length of the curved concave side WB is shorter than the line length in the first step 10B.

When the line length of the curved convex side in the first step 10B is defined as L2, a line length of the curved convex side WA in the second step 10C is preferably set such that a line length L3 of the curved convex side WA of a die in the second step 10C becomes a value that satisfies the following equation (3):

$$L2<L3\leq 1.01\times L2 \quad (3).$$

Furthermore, when the line length of the curved concave side WB in the first step 10B is defined as L2', a line length of the curved concave side WB in the second step 10C is preferably set such that a line length L3' of the curved concave side WB of the die in the second step 10C becomes a value that satisfies the following equation (4):

$$L2'>L3'\geq 0.99\times L2' \quad (4).$$

When L3 is L2 or less, the stress is not reversed on the curved convex side WA at the forming bottom dead center in the second forming step, and the spring-back is not sufficiently suppressed. Furthermore, when L3 is more than 1.01×L2, an excessive tensile stress is generated on the curved convex side WA at the forming bottom dead center in the second forming step, and spring-back in the opposite direction might be generated.

Furthermore, when L3' is L2' or more, the stress is not reversed on the curved concave side WB at the forming bottom dead center in the second forming step, and the spring-back is not sufficiently suppressed. Furthermore, when L3' is less than 0.99×L2', an excessive tensile stress is generated on the curved concave side WB at the forming bottom dead center in the second forming step, and spring-back in the opposite direction might be generated.

The shape of the die used in the second step 10C may also be designed in the designing step 10A by performing, with a computer, simulation analysis in which the metal sheet is press formed into the product shape 1.

Operations and Others

In the method for manufacturing a press formed product of the present embodiment, in order to reduce spring-back, the intermediate component is manufactured by forming the curved part such that, in the first step 10B, the line length of the curved part along the longitudinal direction is shorter than the line length in the product shape 1 on the curved convex side WA and the line length of the curved part along the longitudinal direction is longer than the line length in the product shape 1 on the curved concave side WB, and, in the second step 10C, the curved part of the intermediate component is formed such that the line length of the curved convex side WA is longer than the line length in the first step 10B and the line length of the curved concave side WB is shorter than the line length in the first step 10B, so that an intended manufacturing component is obtained.

A high tensile strength steel sheet is targeted as the metal sheet to be press processed, but a steel sheet or an aluminum sheet may be used.

In the present embodiment, in the forming in the first step 10B, the curved part is formed such that the line length of the curved part along the longitudinal direction is shorter than the line length in the product shape 1 on the curved convex side WA and the line length of the curved part along the longitudinal direction is longer than the line length in the product shape 1 on the curved concave side WB. Furthermore, in the forming in the second step 10C, the manufactured intermediate component is formed such that the line length of the curved convex side WA is longer than the line length in the first step 10B and the line length of the curved concave side WB is shorter than the line length in the first step 10B, so that a small tensile stress is generated on the curved convex side and a small compressive stress is generated on the curved concave side at the press forming bottom dead center in the second step 10C.

Accordingly, the stress difference is reduced, thereby resulting in reduction in the amount of spring-back in the product width direction, and the material strength sensitivity can be reduced even when the material strength varies.

As described above, according to the method for manufacturing a press formed product of the present embodiment, even when a high tensile strength steel sheet is used, spring-back in the product width direction can be greatly reduced without complicating a die. Accordingly, a component having a high-accuracy hat-shaped cross-section curved shape close to the intended product shape 1 can be obtained. As just described, the method for manufacturing a press formed product of the present embodiment has excellent shape fixability and material strength sensitivity.

As a result, according to the present embodiment, even when the material strength varies, a component having high dimensional accuracy can be obtained, thereby leading to improvement in yield. Furthermore, when a vehicle structural component is made using a component having a hat-shaped cross-sectional shape, assembly of the component can be easily performed.

Although the product shape 1 wholly curved in the width direction along the longitudinal direction has been illustrated, the manufacturing method of the present embodiment can be applied to a product shape having one or two or more curved parts curved in the width direction along a part of the longitudinal direction. Furthermore, the cross-sectional shape of the product shape 1 is not limited to the hat-shaped cross-section, and the present embodiment can be applied to a cross-sectional shape such as a U-shaped cross-section.

Figure 6A:
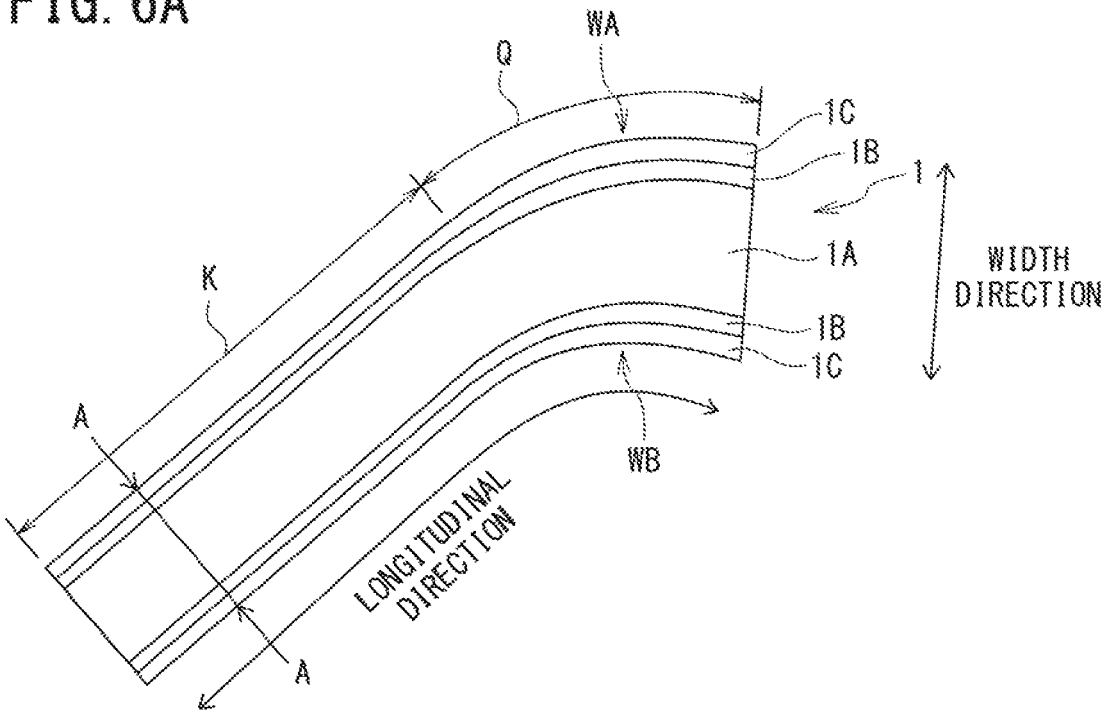
FIG. 6A is a top view and FIG. 6B is a cross-sectional view of A-A in FIG. 6A, which illustrate another example of the product shape.
Figure 6B:
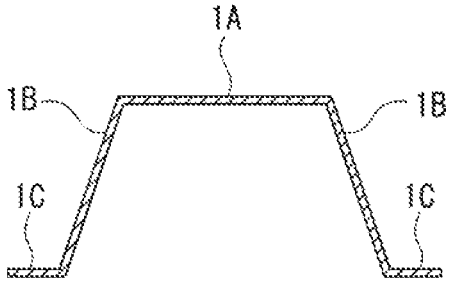

FIG. 6 illustrates a case where the product shape 1 is composed of one straight part K and one curved part Q along the longitudinal direction.

Figure 7A:
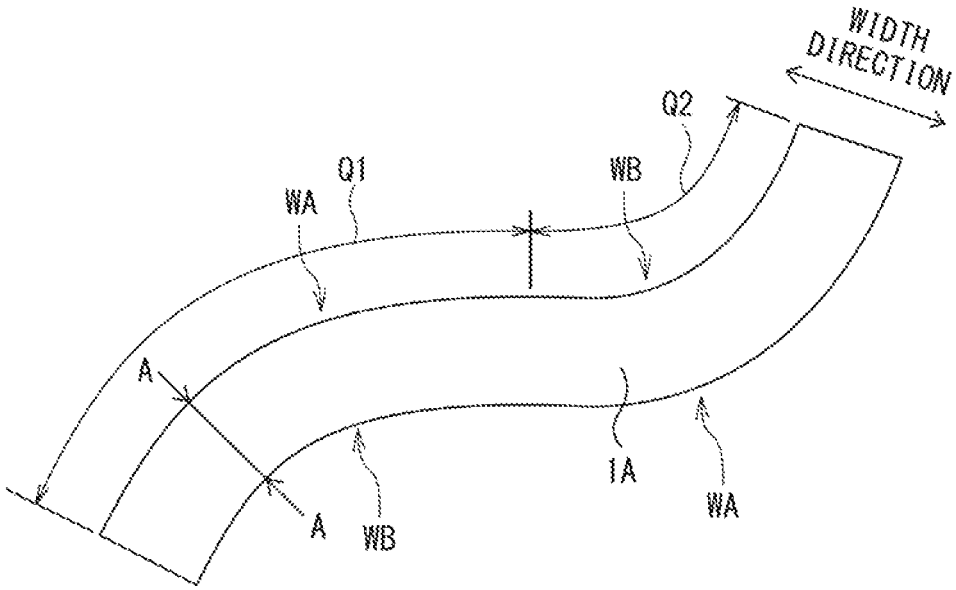
FIG. 7A is a top view and FIG. 7B is a cross-sectional view of A-A in FIG. 7A, which illustrate another example of the product shape.
Figure 7B:
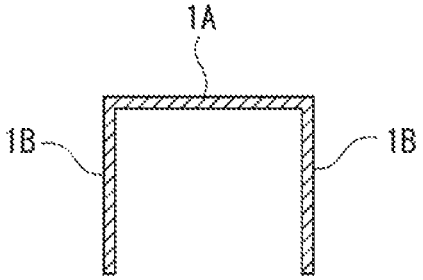

FIG. 7 illustrates a case where the product shape 1 is composed of two curved parts Q1, Q2 along the longitudinal direction. In this case, for each of the curved parts Q1, Q2, the above line lengths may be separately determined.

EXAMPLES

In order to confirm a spring-back reduction effect by the method for manufacturing a press formed product according to aspects of the present invention, press forming analysis and spring-back analysis by a finite element method (FEM) were performed. The results are described below.

In the present example, the case where the substantially hat-shaped cross-section component curved in the width direction along the longitudinal direction in a top view illustrated in FIG. 4 is press formed was targeted. The dimensions of the press formed product (unit: mm) are as illustrated in FIG. 4.

Forming conditions and the amounts of generated spring-back in Comparative Examples (No. 1 to No. 3) and Invention Examples (No. 4 to No. 6) are shown in Table 1.

TABLE 1

| No. | Line Length Difference of Curved Convex Side in First Step (L1-L2) | Line Length Difference of Curved Concave Side in First Step (L2'-L1') | Line Length of Curved Convex Side in Second Step L3 | Line Length of Curved Concave Side in Second Step L3' | Material Strength [MPa] | Amount of Spring-back [mm] |
|---|---|---|---|---|---|---|
| 1 | — | — | — | — | 590 | −9.2 |
| 2 | | | | | 980 | −12.7 |
| 3 | | | | | 1180 | −16.1 |
| 4 | $0.7 \times \lvert L1 \times \varepsilon 1 \rvert$ | $0.3 \times \lvert L1' \times \varepsilon 1' \rvert$ | $1.004 \times L2$ | $0.998 \times L2'$ | 590 | −3.1 |
| 5 | | | | | 980 | −4.8 |
| 6 | | | | | 1180 | −6.5 |

Comparative Examples

In Comparative Examples (No. 1 to No. 3) , as conditions of forming into the product shape 1 by one press forming, press forming analysis and spring-back analysis in a die of the product shape 1 were performed, and the amount of spring-back in the width direction in a top view (displacement in Y direction) was determined.

A metal sheet used in press forming was a steel sheet having a sheet thickness of t=1.6 mm. A steel sheet having a material strength (tensile strength) of 590 MPa was used in No. 1, a steel sheet having a material strength of 980 MPa was used in No. 2, and a steel sheet having a material strength of 1180 MPa was used in No. 3.

As can be seen from Table 1, the amount of spring-back was −9.2 mm in the sample of No. 1, the amount of spring-back was −12.7 mm in the sample of No. 2, the amount of spring-back was −16.1 mm in the sample of No. 3, and the amount of spring-back became larger as the material strength increased.

Invention Examples

On the basis of the results of Comparative Examples described above, in Examples based on the present invention (No. 4 to No. 6), press forming analysis, in which forming is performed such that, in the first step 10B, the line length of the curved convex side WA is shorter than that of the product and the line length of the curved concave side WB is longer than that of the product and such that, in the second step 10C, the line length of the curved convex side WA is longer than the line length in the first step 10B and the line length of the curved concave side WB is shorter than the line length in the first step 10B, was performed.

Specifically, by performing, with a computer, simulation analysis in which each metal sheet is formed into the product shape 1 by one press forming, actually, from the analysis results of Comparative Examples described above, the line length L1 of the longitudinal direction and the average amount of strain ε1 of the longitudinal direction in the compressive stress region of the longitudinal direction generated on the curved convex side WA, and the line length L1' of the longitudinal direction and the average amount of strain ε1' of the longitudinal direction in the tensile stress region of the longitudinal direction generated on the curved concave side WB were determined.

The line lengths of the curved convex side WA and the curved concave side WB in the first step 10B were set such that:

$$L1-L2=0.7\times|L1\times\varepsilon1|$$

$$L2'-L1'=0.3\times|L1'\times\varepsilon1'|$$

where L2 is the line length of the curved convex side WA after the first step 10B, and L2' is the line length of the curved concave side WB after the first step 10B.

Furthermore, the line length L3 of the curved convex side WA in the second step 10C was set to be 1.00×L2, and the line length L3' of the curved concave side WB was set to be 0.998×L2'.

In the same manner as Comparative Examples, a metal sheet used in press forming was a steel sheet having a sheet thickness of t=1.6 mm. More specifically, a steel sheet having a material strength (tensile strength) of 590 MPa was used in No. 4, a steel sheet having a material strength of 980 MPa was used in No. 5, and a steel sheet having a material strength of 1180 MPa was used in No. 6.

Under the above conditions, press forming analysis was performed using a model of the die in the first step 10B, and spring-back analysis after the press formed product formed to the forming bottom dead center is removed from the die was performed. Then, forming analysis in which the formed product after the spring-back is restrike formed in the second step 10C was performed, and spring-back analysis after the press formed product formed to the forming bottom dead center is removed from the die was performed.

When the manufacturing method according to aspects of the present invention is applied, as can be seen from Table 1, the amount of spring-back was −3.1 mm in the sample of No. 4, the amount of spring-back was −4.8 mm in the sample of No. 5, and the amount of spring-back was −6.5 mm in the sample of No. 6.

More specifically, in Invention Examples, the amount of spring-back was reduced compared to Comparative Examples. Furthermore, in a comparison of a dimensional accuracy difference between the 590 MPa material and the 1180 MPa material, the dimensional accuracy difference was 6.9 mm in Comparative Examples, whereas the dimensional accuracy difference was 3.4 mm and a variation in dimensional accuracy was reduced in Invention Examples.

It is found that, even when the material strength varies, a component having high dimensional accuracy can be obtained by applying aspects of the present invention as described above.

The entire contents of Japanese Patent Application No. 2017-152412 (filed on Aug. 7, 2017) to which the present application claims priority are a part of the present disclosure by reference.

Although the present invention has been described with reference to the limited number of embodiments, the scope of the present invention is not limited thereto, and modifications of the respective embodiments based on the above disclosure are obvious to those skilled in the art.

REFERENCE SIGNS LIST

1 product shape
1A top plate part
1B side wall part
1C flange part
1*a*, 1*b* bent line position
10A designing step
10B first step
10C second step
K straight part
Q, Q1, Q2 curved part
WA curved convex side
WB curved concave side

The invention claimed is:

1. A method for manufacturing a press formed product comprising:

when a metal sheet is press formed to manufacture a product having a product shape of a cross-sectional shape in which both sides of a top plate part in a width direction are continuous with side wall parts and having a curved part curved in the width direction along a longitudinal direction, a first step of manufacturing an intermediate component by forming the curved part such that a line length along the longitudinal direction of a curved convex side that is a convex side of a curve is shorter than a line length in the product shape and a line length along the longitudinal direction of a curved concave side that is a concave side of the curve is longer than a line length in the product shape; and a second step of forming the intermediate component such that a line length of the curved convex side at the bent line position between the top plate part and the side wall part or at the end position in the width direction of the side wall part is longer than the line length in the first step and a line length of the curved concave side at the bent line position between the top plate part and the side wall part or at the end position in the width direction of the side wall part is shorter than the line length in the first step, wherein a line length L1 of the longitudinal direction and the average amount of strain ε1 of the longitudinal direction in a compressive stress region of the longitudinal direction generated on the curved convex side are determined by performing, with a computer, simulation analysis in which the metal sheet is formed into the product shape by one press forming, and, when a line length of the curved convex side after the first step is defined as L2, a line length of the curved convex side in the first step is set such that the following equation (1) is satisfied:

$$0<L1-L2\leq2\times|L1\times\varepsilon1| \quad (1).$$

2. A method for manufacturing a press formed product comprising:

when a metal sheet is press formed to manufacture a product having a product shape of a cross-sectional shape in which both sides of a top plate part in a width direction are continuous with side wall parts and having a curved part curved in the width direction along a longitudinal direction, a first step of manufacturing an intermediate component by forming the curved part such that a line length along the longitudinal direction of a curved convex side that is a convex side of a curve is shorter than a line length in the product shape and a line length along the longitudinal direction of a curved concave side that is a concave side of the curve is longer than a line length in the product shape; and a second step of forming the intermediate component such that a line length of the curved convex side at the bent line position between the top plate part and the side wall part or at the end position in the width direction of the side wall part is longer than the line length in the first step and a line length of the curved concave side at the bent line position between the top plate part and the side wall part or at the end position in the width direction of the side wall part is shorter than the line length in the first step, wherein a line length L1' of the longitudinal direction and the average amount of strain ε1' of the longitudinal direction in a tensile stress region of the longitudinal direction generated on the curved concave side are determined by performing, with a computer, simulation analysis in which the metal sheet is formed into the product shape by one press forming, and, when a line length of the curved concave side after the first step is defined as L2', a line length of the curved concave side in the first step is set such that the following equation (2) is satisfied:

$$0<L2'-L1'\leq 2\times|L1'\times\varepsilon 1'| \quad (2).$$

3. The method for manufacturing a press formed product according to 1, wherein drawing or stamping is applied to the forming in the first step, and restrike processing is applied to the forming in the second step.

4. The method for manufacturing a press formed product according to 1, wherein the metal sheet is a steel sheet having a material strength of 590 MPa or more.

5. The method for manufacturing a press formed product according to claim 1, wherein a line length L1' of the longitudinal direction and the average amount of strain ε1' of the longitudinal direction in a tensile stress region of the longitudinal direction generated on the curved concave side are determined by performing, with a computer, simulation analysis in which the metal sheet is formed into the product shape by one press forming, and, when a line length of the curved concave side after the first step is defined as L2', a line length of the curved concave side in the first step is set such that the following equation (2) is satisfied:

$$0<L2'-L1'\leq 2\times|L1'\times\varepsilon 1'| \quad (2).$$

6. The method for manufacturing a press formed product according to claim 5, wherein drawing or stamping is applied to the forming in the first step, and restrike processing is applied to the forming in the second step.

7. The method for manufacturing a press formed product according to claim 3, wherein the metal sheet is a steel sheet having a material strength of 590 MPa or more.

8. The method for manufacturing a press formed product according to claim 5, wherein the metal sheet is a steel sheet having a material strength of 590 MPa or more.

9. The method for manufacturing a press formed product according to claim 6, wherein the metal sheet is a steel sheet having a material strength of 590 MPa or more.

10. The method for manufacturing a press formed product according to claim 2, wherein drawing or stamping is applied to the forming in the first step, and restrike processing is applied to the forming in the second step.

11. The method for manufacturing a press formed product according to claim 2, wherein the metal sheet is a steel sheet having a material strength of 590 MPa or more.

12. The method for manufacturing a press formed product according to claim 10, wherein the metal sheet is a steel sheet having a material strength of 590 MPa or more.

* * * * *